United States Patent [19]

Sanvito

[11] 4,116,142

[45] Sep. 26, 1978

[54] WORKPIECE TENSIONING DEVICE FOR A SEWING UNIT

[75] Inventor: Roberto Sanvito, Milan, Italy

[73] Assignee: Rockwell-Rimoldi S.p.A., Milan, Italy

[21] Appl. No.: 837,680

[22] Filed: Sep. 29, 1977

[30] Foreign Application Priority Data

Oct. 29, 1976 [IT] Italy ..... 28836 A/76

[51] Int. Cl.$^2$ ..... D05B 21/00

[52] U.S. Cl. ..... 112/121.26; 112/121.15

[58] Field of Search ..... 112/121.26, 121.15, 112/203, 136, 153

[56] References Cited

U.S. PATENT DOCUMENTS

| | | | |
|---|---|---|---|
| 3,713,408 | 1/1973 | Deeks et al. | 112/121.26 X |
| 3,761,073 | 9/1973 | Brain | 112/121.15 X |
| 3,791,323 | 2/1974 | Pierson et al. | 112/121.15 |
| 3,903,818 | 9/1975 | Marforio | 112/121.26 X |
| 4,013,025 | 3/1977 | Marforio | 112/121.26 X |
| 4,030,430 | 6/1977 | Pickert et al. | 112/121.26 |
| 4,037,546 | 7/1977 | Kleinschmidt | 112/121.26 |
| 4,062,309 | 12/1977 | Pollmeier et al. | 112/121.26 X |
| 4,066,027 | 1/1978 | Marforio | 112/121.26 X |

*Primary Examiner*—Werner H. Schroeder
*Assistant Examiner*—Andrew M. Falik

[57] ABSTRACT

A positioning device for a traveling gripper in a sewing unit having a cable element interconnecting the gripper with a return device for applying tension to a workpiece being advanced to the sewing machine and returning the gripper to its starting position upon release of the workpiece therefrom. The positioning device defines the grippers starting position and includes a pair of divergent tongues for receiving the gripper therebetween. The cable element is attached to the gripper at a location displaced from its longitudinal axis and is effective through its pulling force, in pivoting the gripper when entering the positioning device to a location in readiness for the next stitching cycle.

2 Claims, 4 Drawing Figures

FIG. 1
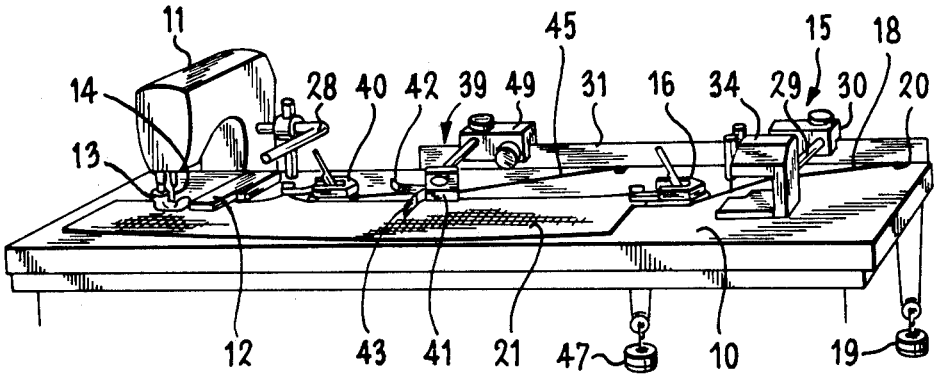
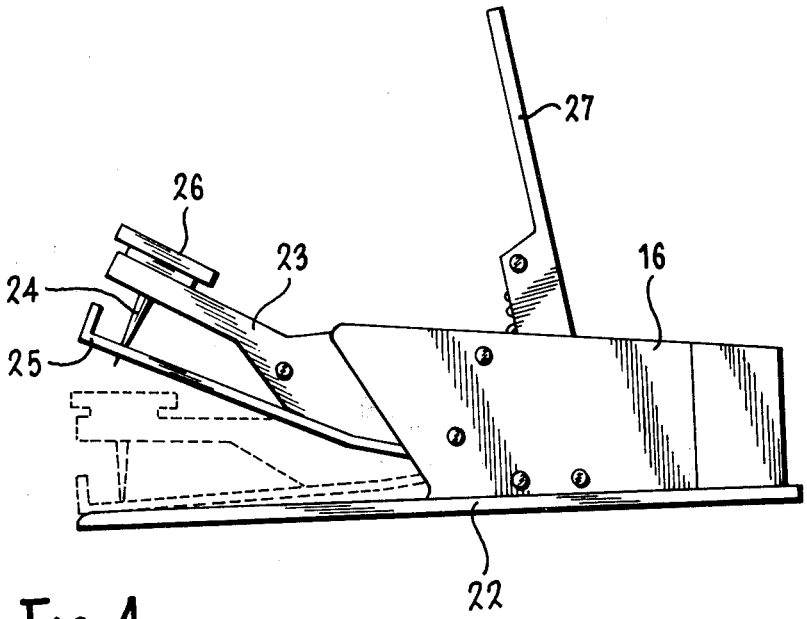
FIG. 4

WORKPIECE TENSIONING DEVICE FOR A SEWING UNIT

BACKGROUND OF THE INVENTION

The present invention pertains to a device for positioning and applying tension to a workpiece, such as trouser fabric during advancement thereof to the stitching instrumentalities of a sewing unit. A well known and common form of sewing unit is that of table-like structure having a sewing or work surface with a sewing machine mounted adjacent one end of said surface. The sewing machine includes the usual stitching and feeding elements, and the unit is provided with one or more tensioning devices defining traveling grippers having movable jaws for gripping and releasing the workpiece in timed sequence with the sewing cycle. The grippers are attached to cable-like elements that are effective in holding the workpiece taut and for returning said grippers to their starting position upon completion of the sewing cycle. The grippers also include adjustable positioning members mounted on the work surface for locating said grippers in their starting positions. The cable-like elements connected to the grippers are adapted to extend through central openings in the positioning members and their opposite ends are attached to counter-weights which serve to return said grippers to their starting positions upon release from the workpiece. The tension device is operatively associated with a feeder device of known type, and is adapted to locate a workpiece in a predetermined location for attachment of the grippers thereto upon their return to their respective positioning members located in starting position. The ability to continuously locate a gripper or grippers in the same starting position relative to the length of a workpiece to be gripped thereby presents a serious problem with tension devices that are adapted to move unrestricted with a workpiece along the work surface. Locating devices are available for the known types of sewing units and are effective in orienting the traveling grippers, upon return to their positioning members, to a position for engaging the next workpiece prior to commencement of another stitching cycle. These locating devices are considered rather complex, require a large number of interconnected elements to accomplish their intended function, and require separate and costly electro-pneumatic control circuits for their operation.

In the case of an additional tensioning device for gripping the workpiece intermediate the ends thereof, utilization of the available locating devices would be practically impossible due to the great number of additional interconnected elements that would be required. Additionally, difficulty would be encountered in attempting to interconnect its operating circuit with that of the end tensioning device for the sequence of operation of both devices differ within the range of the total operating cycle of the sewing unit.

An object of the present invention is to provide a traveling gripper positioning device for sewing units which is of simplified construction, inexpensive to manufacture and which will consistently and accurately perform its intended function.

A more specific object is that of providing a positioning device for an intermediate traveling gripper which is capable of functioning independently of and without operatively interfering with the positioning device for the gripper which holds the end of a workpiece.

The technical problem to be solved in order to achieve the above-mentioned objects is that of eliminating the electropneumatic controls for the locating devices. The solution to this technical problem is accomplished by means of gripper return devices which upon return of a gripper to its starting position, is effective in causing pivotal movement of said gripper which orients it to a predetermined position and in readiness for attachment to the next workpiece.

SUMMARY OF THE INVENTION

Specifically, the present invention pertains to traveling type grippers for applying tension to a workpiece, such as trouser fabric as the latter is caused to move along the work surface to a sewing machine of a sewing unit. Return devices connected to the grippers are effective in maintaining the workpiece taut as it is advanced to the stitching instrumentalities and upon completion of the stitching cycle are effective in returning said grippers to positioning devices in their starting positions. The gripper is interconnected to the return device by means of a cable which is adapted to slide freely through a central opening provided in said gripper's positioning device. The positioning device includes a pair of divergent tongues for receiving the gripper therebetween upon its return to starting position. The cable is attached to the gripper adjacent one end thereof and at a point that is displaced, relative to the longitudinal axis of the gripper, and that portion of the fabric adapted to be held by said gripper. This displacement of the point of attachment of the cable relative to the longitudinal axis of the gripper is effective in causing pivotal movement of the latter, after entering its positioning device, which is generated by the force of the return device that is transmitted through the cable when returning said gripper to starting position.

These and other features of the present invention will be made apparent from the following detailed description thereof which is provided with reference to the accompanying drawings, in which:

BRIEF DESCRIPTION OF THE DRAWINGS

FIG. 1 is a perspective view of a sewing unit showing the workpiece tensioning device according to the invention applied thereto;

FIG. 4 is a view in side elevation of a traveling gripper.

DESCRIPTION OF THE PREFERRED EMBODIMENT

Figure 2:
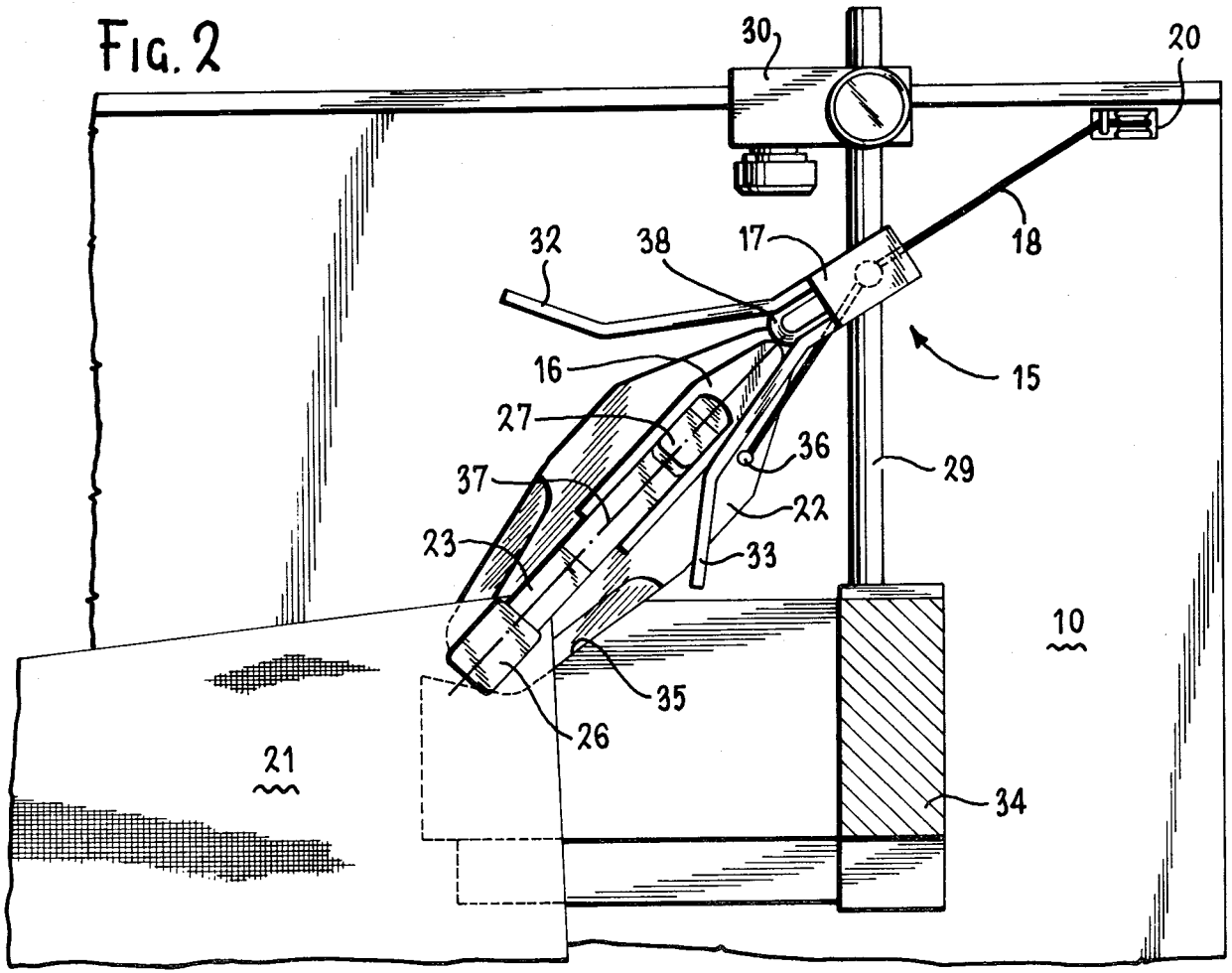
FIGS. 2 and 3 are top views of an end tension device and an intermediate tension device respectively.

With reference to FIG. 1, a fabric sewing unit suitable, for example, for trouser fabrics and the like consists, in general, of a work surface 10 on which a sewing machine 11 is mounted having a conventional type of work guide 12, a presser foot 13, and a needle 14 all of which function in a known manner with well known stitching and feed elements (not shown). Adjacent the end of the work surface 10 opposite that where the sewing machine 11 is mounted an end tension device generally indicated by numeral 15 is provided (FIGS. 1 and 2) which includes a gripper 16, an adjustable positioning member 17, and a cable element 18 that is slidable and threaded through a central opening provided in the adjustable positioning member 17. One end of the cable element 18 is attached adjacent to one side of the gripper 16 and extending through the positioning member 17 the opposite end is operatively associated with a return device 19 that consists of interchangeable counter-weights that are located beneath the work surface 10. The work surface 10 is provided with an opening 20 through which the cable 18 passes and being in vertical alignment with the counter-weights it serves to facilitate movement of said cable. The gripper 16 serves to grip the trailing end of two superimposed lengths of fabric that form the workpiece 21 to be stitched and must be maintained in alignment one with the other so as to be properly joined during the stitching cycle. The gripper 16, as best shown in FIG. 4 is provided with a lower planar surface 22 which engages the work surfaces 10 and on which it is adapted to slide unrestricted during the performance of said gripper's intended function. The gripper also includes a pivotable jaw 23 that has a pin 24 which is adapted to penetrate the workpiece 21 which when held by said gripper is located intermediate the planar surface 22 and said jaw 23. In order to maintain a firm grip on the workpiece the jaw 23 is provided with a resilient plate 25, the function of which is to press said fabric against the upper side of the planar surface 22. The pivotable jaw 23 is closed by manually pushing downwardly on a knob 26 that forms a part of said jaw so as to engage a locking device (not shown). To automatically open the jaw, the latter includes a generally vertically extending level 27 which is adapted to be engaged and pivoted by a horizontal rod 28 that is disposed adjacent the sewing machine 11. When the gripper 16, drawn by the workpiece 21 approaches the sewing machine 11, the lever 27 is pivoted by the horizontal rod 28 and causes release of the above-mentioned locking device and the opening of the pivotable jaw 23 so as to release the workpiece held thereby. Under the action of the return device 19, the gripper 16 is drawn by the cable 18 toward the positioning member 17. The positioning member 17 is adjustably mounted on a rod 29 that is mounted in and extends from a support block 30. This support block is adjustably mounted on a side rail 31 which is attached to and extends along one side of the work surface 10. The side rail 31 serves to locate the support block 30 and consequently the positioning member 17 relative to the location of the sewing machine 11 and the length of the layers of fabric placed therebetween at the start of a stitching cycle. The positioning member 17 includes a pair of divergent tongues 32 and 33 which are disposed so as to receive the gripper 16 when it returns after having released the workpiece 21. Specifically, the tongue identified by numeral 32 extends generally in the same direction of movement as the fabric, whereas the tongue identified by numeral 33 extends in the direction of a feeder device 34 that is positioned on the work surface 10 by means of a rod 29.

Figure 3:
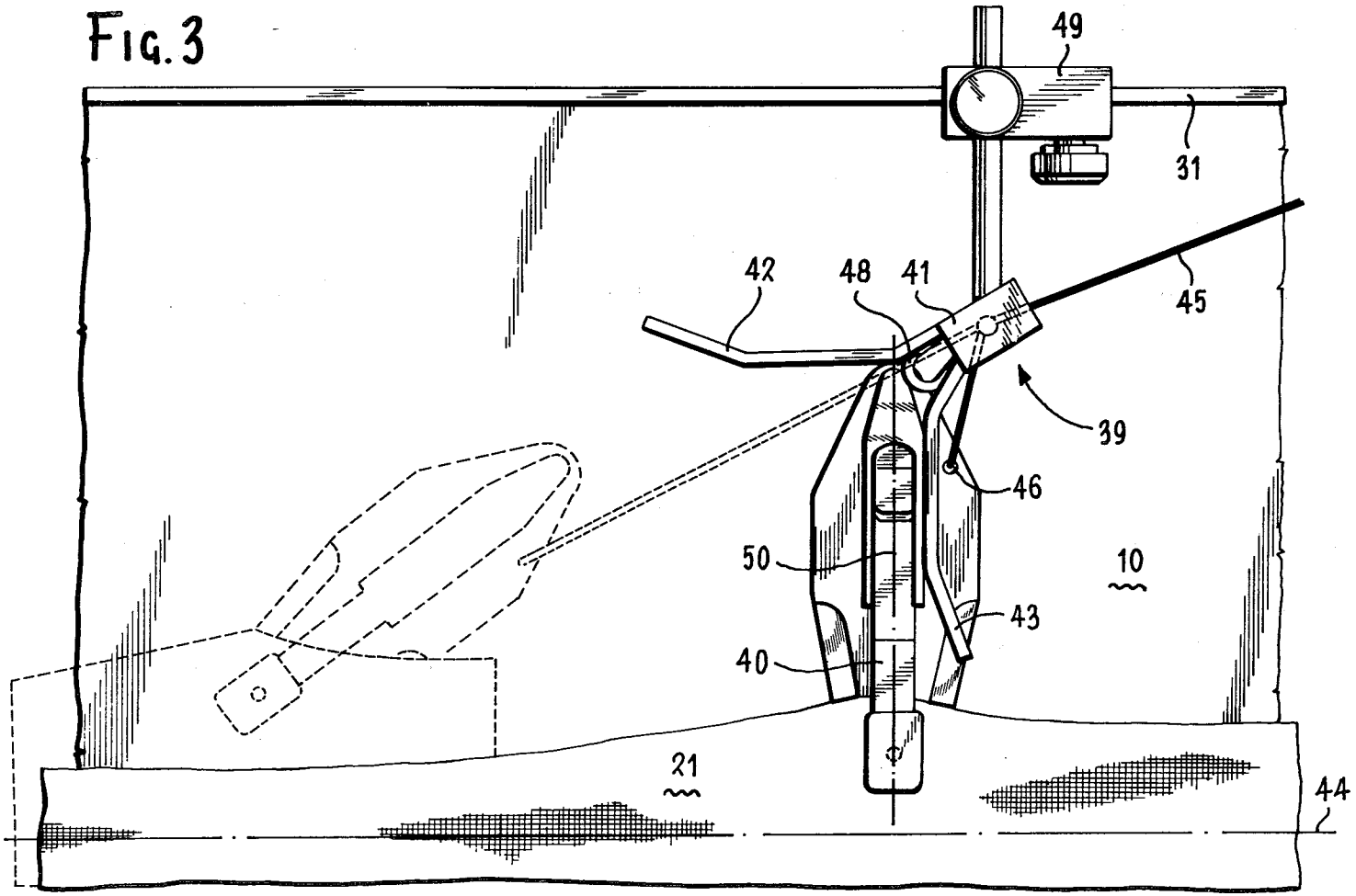

The feeder device 34 is of a well known type and enables an operator to consistently locate the layers of fabric to be joined in the same predetermined position for permitting attachment of the gripper thereto and serves to substantially reduce the time required for preparing fabrics for stitching. To attach the gripper to the layers of fabric positioned by the feeder device, the gripper on return to the positoning member must be pivoted toward said feeder device and into a recess 35 provided therein so as to locate the pin 24 of said gripper in vertical alignment with that portion of said layers of fabric it will be caused to penetrate. The gripper 16 is pivoted by means of the cable element 18 which is attached to the planar surface 22 at a location identified by numeral 36 in FIG. 2 and which is displaced from the longitudinal axis 37 of said gripper on that side of the latter adjacent the feeder device 34. Pivotal movement of the gripper 16 is accomplished by means of a shock absorber 38 located intermediate the inner ends of the divergent tongues 32 and 33 which is adapted to be engaged by the rearward end of said gripper on its return to starting position and provides a surface about which said gripper is caused to pivot under the influence of the forces developed by the cable element 18 when acted upon by the return device 19. A cessation of pivotal movement of the gripper 16 is had when it engages the tongue 33 which is effective in locating said gripper in the required position for attachment to the next workpiece. When layers of fabric are joined that are very long and that have irregular outlines that extend outwardly beyond the imaginary line that interconnects the end tension device 15 with the presser foot 13, along which line maximum tension is developed on the fabric, an intermediate tension device generally indicated by numeral 39 (FIGS. 1 and 3) is provided. This device serves to grip the workpiece 21 intermediate the ends thereof and maintains the areas having irregular outlines flat on the work surface which without said device would bunch up during movement along said work surface due to the tension applied by the end tension device 15. The intermediate tension device 39, as shown in FIG. 3, includes a gripper 40 that is identical to the gripper 16 and an adjustable positioning member 41 having a pair of divergent tongues 42 and 43 that extend in directions substantially 90° one from the other. More precisely, the tongue identified by numeral 42 is directed toward the sewing machine 11 so that it extends substantially parallel to the direction of movement 44 of the material, whereas the tongue 43 is disposed substantially perpendicular to said direction 44 and to the workpiece 21 to be held by the gripper 40.

The gripper 40 is also attached to a cable element that is depicted by numeral 45 and at a location identified by numeral 46 which as with the gripper 16 is displaced from the longitudinal axis 50 of said gripper 40. The gripper 40 also includes a return device which is in the form of counter weights 47 and are effective through cable element 45 in returning said gripper 40 to its positioning member 41 that is provided with a shock absorber 48 disposed intermediate the inner ends of the divergent tongues 42 and 43. As soon as the trailing end of the gripper 40 engages the shock absorber 48 on its return movement, it immediately is caused to pivot in the direction of the tongue 43. Upon engagement of the gripper 40 with the tongue 43 said gripper is automatically located in the desired position for attachment to the next workpiece.

The positioning member 41 also includes a support block that is depicted by numeral 49 which like support block 30 is adjustably mounted on the side rail 31 so as to permit selective positioning of said positioning member 41 on the work surface 10.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A workpiece tensioning and positioning device for a traveling gripper movable along the work surface of a sewing unit while holding a workpiece being advanced to the stitching instrumentalities of a sewing machine mounted adjacent one end of the work surface, said workpiece tensioning and positioning device comprising:

(a) a cable element interconnecting the traveling gripper with a return device for applying tension to the workpiece while being advanced to the sewing machine and returning the gripper to its starting position upon release of the workpiece therefrom.

(b) a positioning member mounted on the work surface defining the starting position for the traveling gripper which includes;

(i) a pair of divergent tongues having a shock absorber assembled intermediate the inner ends thereof;

(ii) means defining a central opening in said positioning member through which said cable element is caused to travel during movement of the traveling gripper; and (c) said cable element being attached to the traveling gripper at a location displaced from its longitudinal axis for effecting pivotal movement thereof, upon its return to starting position, to a location in readiness for attachment to a workpiece.

2. The workpiece tensioning and positioning device according to claim 1 wherein one of said divergent tongues extends in a direction substantially parallel with the direction of advancement of the workpiece and the other in a direction substantially normal to the direction of advancement.

* * * * *